US011465827B2

(12) United States Patent
Ritzenhoff

(10) Patent No.: US 11,465,827 B2
(45) Date of Patent: Oct. 11, 2022

(54) CONTAINER CLOSURE FOR A BEVERAGE CAN

(71) Applicant: SEIDEL GMBH & CO. KG, Marburg (DE)

(72) Inventor: Andreas Franz Christian Ritzenhoff, Marburg (DE)

(73) Assignee: SEIDEL GMBH & CO. KG, Marburg (DE)

( * ) Notice: Subject to any disclaimer, the term of this patent is extended or adjusted under 35 U.S.C. 154(b) by 117 days.

(21) Appl. No.: 16/763,299

(22) PCT Filed: Oct. 15, 2018

(86) PCT No.: PCT/EP2018/078103
§ 371 (c)(1),
(2) Date: May 12, 2020

(87) PCT Pub. No.: WO2019/091707
PCT Pub. Date: May 16, 2019

(65) Prior Publication Data

US 2020/0299055 A1 Sep. 24, 2020

(30) Foreign Application Priority Data

Nov. 13, 2017 (DE) ..... 10 2017 220 149.5

(51) Int. Cl.
*B65D 85/73* (2006.01)
*B65D 17/28* (2006.01)

(52) U.S. Cl.
CPC ..... *B65D 85/73* (2013.01); *B65D 17/4012* (2018.01); *B65D 2517/005* (2013.01); *B65D 2517/0014* (2013.01)

(58) Field of Classification Search
CPC ..... B65D 85/73; B65D 17/4012; B65D 2517/0014; B65D 2517/005;
(Continued)

(56) References Cited

U.S. PATENT DOCUMENTS 5,720,412 A 2/1998 Ficken
6,345,735 B1 * 2/2002 Harvey ..... B67D 1/1411 222/190

(Continued)

FOREIGN PATENT DOCUMENTS

DE 19942827 A1 3/2001
EP 2426058 A1 * 3/2012 ..... B65D 17/4014

(Continued)

OTHER PUBLICATIONS

PCT International Search Report and Written Opinion, PCT/EP2018/078103, dated Dec. 14, 2018, 15 pages.

*Primary Examiner* — Valentin Neacsu
*Assistant Examiner* — John Martin Hoppmann
(74) *Attorney, Agent, or Firm* — Quarles & Brady LLP

(57) ABSTRACT

A container closing device for a beverage can having an opening tab which is disposed on a can lid and pivotable about a pivot reception formed in a lid bottom, the opening tab being provided with a reactive surface on its underside facing the lid bottom for contact with a liquid pouring from the pouring opening, a sealed space being realized in the area of the reactive surface and a closing piece disposed in the lid bottom between a pouring protrusion and the lid bottom so that the reactive surface is disposed at least partially in the sealed space and is sealed against the environment.

14 Claims, 10 Drawing Sheets

(58) Field of Classification Search
CPC ..... B65D 2517/0056; B65D 17/4014; B65D 1/0207; B65D 1/0246; B65D 2517/00; B65D 2517/0001; B65D 2517/0031; B65D 2517/004; B65D 2517/0041; B65D 2517/0043; B65D 2517/0044; B65D 2517/0046; B65D 2517/0047; Y10S 220/906; B65B 31/00; B65B 7/2842; B67D 1/1275
USPC ..... 220/270, 521, 906; 426/118, 115, 397, 426/424, 447; 222/564
See application file for complete search history.

(56) References Cited

U.S. PATENT DOCUMENTS

| | | | | |
|---|---|---|---|---|
| 6,347,720 | B1 | 2/2002 | Schley | |
| 2006/0201944 | A1* | 9/2006 | Shibasaka | B29C 43/18 220/254.1 |
| 2010/0213194 | A1* | 8/2010 | Liu | B65D 17/4012 220/269 |
| 2012/0012586 | A1* | 1/2012 | Rinderer | B65D 17/4014 220/269 |

FOREIGN PATENT DOCUMENTS

| | | | | |
|---|---|---|---|---|
| EP | 2885227 | B1 | 9/2016 | |
| JP | 2004001871 | A * | 1/2004 | |
| WO | WO-9416967 | A1 * | 8/1994 | B65D 85/73 |
| WO | WO-2014027028 | A1 * | 2/2014 | B65B 3/04 |
| WO | WO-2017032752 | A1 * | 3/2017 | B65D 17/4014 |
| WO | 2017076829 | A1 | 5/2017 | |
| WO | WO-2017076829 | A1 * | 5/2017 | B65D 23/12 |

* cited by examiner

CONTAINER CLOSURE FOR A BEVERAGE CAN

This application represents the national stage entry of PCT International Application No. PCT/EP2018/078103 filed Oct. 15, 2018, which claims priority to German Patent Application DE 10 2017 220 149.5, filed Nov. 13, 2017. Each of these applications is hereby incorporated herein by reference for all purposes.

The present disclosure relates to a container closing device for a beverage can having an opening tab which is disposed on a can lid, is pivotable about a pivot reception formed in a lid bottom and comprises a push opener on one side of a pivot axis received in the pivot reception and an actuating end on an opposite side of the pivot axis for handling, the lid bottom comprising a closing piece, which is divided from the surrounding lid bottom via a predetermined breaking device, below the push opener in such a manner that the closing piece is pressurized via the push opener as a result of a pivoting movement of the opening tab and is detached from the connection to the surrounding lid bottom along the predetermined breaking device for releasing a pouring opening.

Container closing devices of the type mentioned above have been disclosed in EP 1 097 087 B1, for example. EP 2 885 227 B1 further discloses providing beverage cans with a reactive surface such that a beverage product received in the beverage container comes into contact with the reactive surface while the beverage product is being poured from the beverage container. Furthermore, it is disclosed in EP 2 885 227 B1 that the reactive surface is designed as a surface which encourages bubble growth and nucleation upon contact with a liquid which contains oversaturated nitrogen or a gas mixture having dissolved nitrogen. For this purpose, the known reactive surface is realized such that it has a plurality of pits having a size between 6 nm and 100 nm.

It is the object of the disclosure to design a container closing device for a beverage can in such a manner that liquid only comes into contact with a reactive surface after the beverage can has been opened and that the effect of the reactive surface cannot be negatively affected by external influences before opening the beverage can.

To attain this object, the container closing device according to the disclosure comprises a pouring protrusion which is disposed on the same side of the pivot axis as the push opener, covers the closing piece and comprises a support end for supporting the pouring protrusion at the lid bottom during the pivoting movement of the opening tab, the opening tab being provided with a reactive surface on its underside facing toward the lid bottom for contact with a liquid flowing from the pouring opening, a sealed space being realized in the area of the reactive surface and the closing piece between the pouring protrusion and the lid bottom in such a manner that the reactive surface is at least partially disposed in the sealed space and is sealed against the environment above the lid bottom.

It can be ensured by means of the container closing device which is based on the disclosure, has the reactive surface outside of a liquid-receiving space, i.e., above the lid bottom, due to its design according to the disclosure and, on the other hand, prevents a negative effect on the properties of the reactive surface via the environment by at least a partial area of the reactive surface being disposed in a sealed space that a liquid only comes into contact with the reactive surface after the beverage can has been opened in each instance, the efficiency of the reactive surface being ensured by a contact with the surrounding medium being prevented before an imminent opening of the beverage can by at least a partial area of the reactive surface being disposed in the sealed space.

It can be prevented in particular that deposits build up on the reactive surface which would negatively affect the efficiency of the reactive surface by the pore diameter being reduced as a result of deposits of surrounding dust or surrounding liquid when an effect of the reactive surface is based on pore growth in the reactive surface.

Preferably, an elastic sealing device is provided for sealing the sealed space between the pouring protrusion and the lid bottom so that any unevenness in the lid bottom which can occur when a beverage can is stored or handled can be compensated by the sealing device.

If the predetermined breaking device realized in the lid bottom is disposed entirely in the sealed space, it is ensured that the sealing effect of the sealing device cannot be negatively affected by the predetermined breaking device.

If the reactive surface realized on the underside of the pouring protrusion is disposed entirely in the sealed space, it can be ensured, moreover, that a possibly porous reactive surface also cannot negatively affect the sealing effect.

Preferably, the sealing device comprises sealing receptions which are disposed in the lid bottom and/or the underside of the pouring protrusion and serve to receive a sealing means so that the sealing effect can be produced at defined positions.

If the sealing receptions are at least partially realized as receiving beads realized in the underside of the pouring protrusion and/or (in) the lid bottom, producing the sealing receptions in one work step with the container closing device becomes possible, preferably by a stamping process.

It proves to be particularly advantageous if the support end of the pouring protrusion is realized as a rim web which is supported at the lid bottom having the sealing means sandwiched therebetween so that high sealing forces can be generated by an essentially linear contact between the rim web and the sealing means, the sealing forces enabling maintaining the sealing effect even under high mechanical loads of the beverage can and in particular the lid bottom and deformations resulting therefrom.

If the support end of the pouring protrusion is realized as a rim web which is supported at the lid bottom adjacent to the sealing means disposed on the underside of the pouring protrusion, the sealing means can be particularly well shielded from outer influences.

An embodiment has proven particularly advantageous in which the sealing device comprises a lid-bottom seal and a pouring-protrusion seal, a radially outer bead section, which extends parallel to the rim web of the pouring protrusion and extends in the circumferential direction of the lid bottom, and two bead sections, which are directed inward and each extend transversally to the circumference from the ends of the radially outer bead section, being provided for realizing the lid-bottom seal in the lid bottom, a radially inner bead section being realized in the underside of the pouring protrusion for realizing the pouring-protrusion seal, the radially inner bead section extending between free end sections of the bead sections, which are directed inward and realized in the lid bottom, in such a manner that a sealing means, which is disposed in the radially inner bead section of the pouring protrusion, covers axial sealing ends of the sealing means disposed in the bead sections of the lid-bottom seal, which are directed inward, with axial sealing ends.

If the sealing device is realized as a sealing frame disposed in the pouring protrusion and having a circumferential bead formed in the underside of the pouring protrusion, it is possible to use a conventionally realized lid bottom, i.e., a lid bottom on which no sealing device is provided, for producing the container closing device.

It is also possible to realize the sealing device as a sealing frame disposed on the lid bottom and having a circumferential bead realized in the lid bottom so that the pouring protrusion can be realized as an essentially flat surface blank.

Preferably, the reactive surface is realized as a surface for encouraging bubble nucleation and growth in a liquid received in the beverage can and containing oversaturated nitrogen or a gas mixture having dissolved nitrogen, the reactive surface comprising a plurality of pits which are preferably sized between 5 nm and 150 nm.

It is particularly preferred if the reactive surface is provided with a preferably anodically produced aluminum oxide coating of a partial area of the underside of the pouring protrusion.

The beverage can according to the disclosure has the features of claim 14.

In the following, preferred embodiments of the disclosure are described in more detail by means of the drawing.

Figure 1:
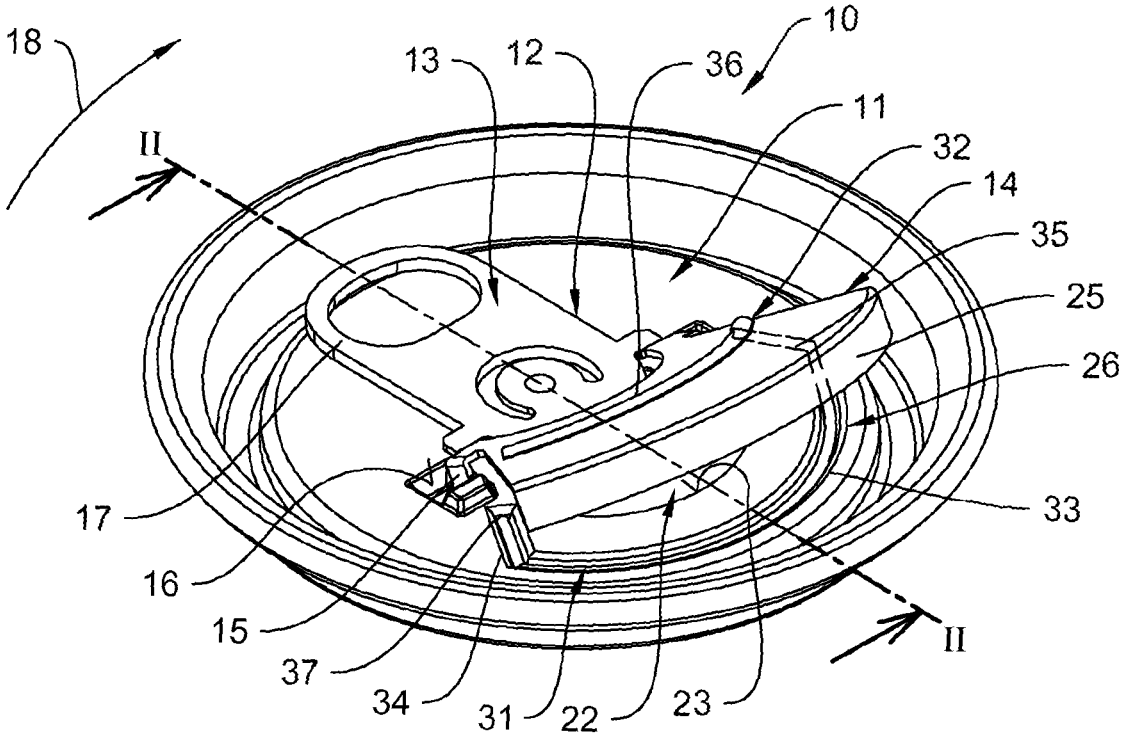
FIG. 1 shows an isometric view of a container closing device in a first embodiment realized on a can lid of a beverage can and being open.
Figure 2:
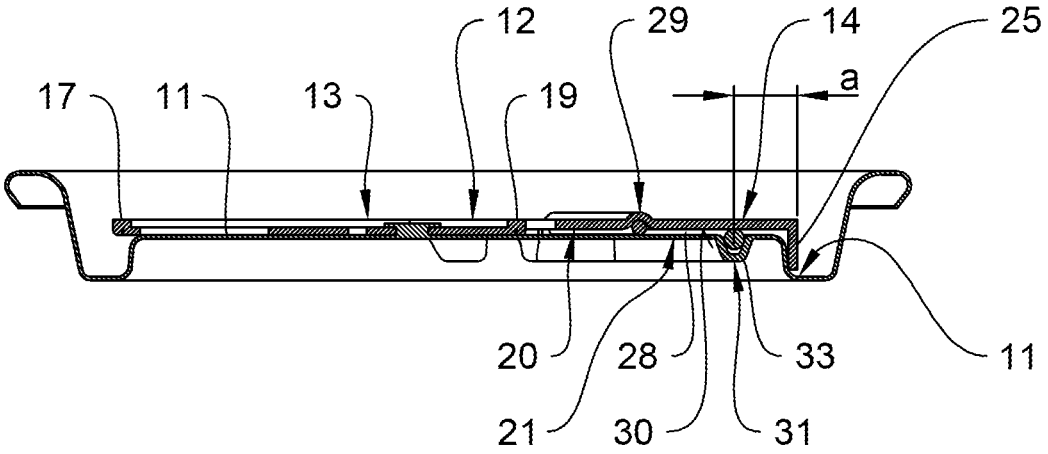
FIG. 2 shows a sectional view according to line II-II in FIG. 1 of the can lid illustrated in FIG. 1 having a closed container closing device.
Figure 2A:
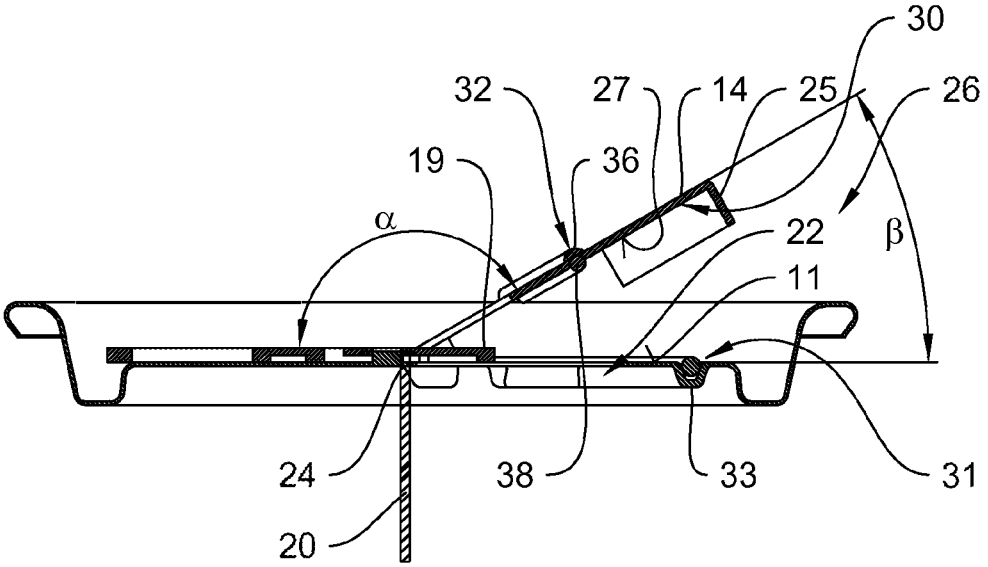
Figure 3:
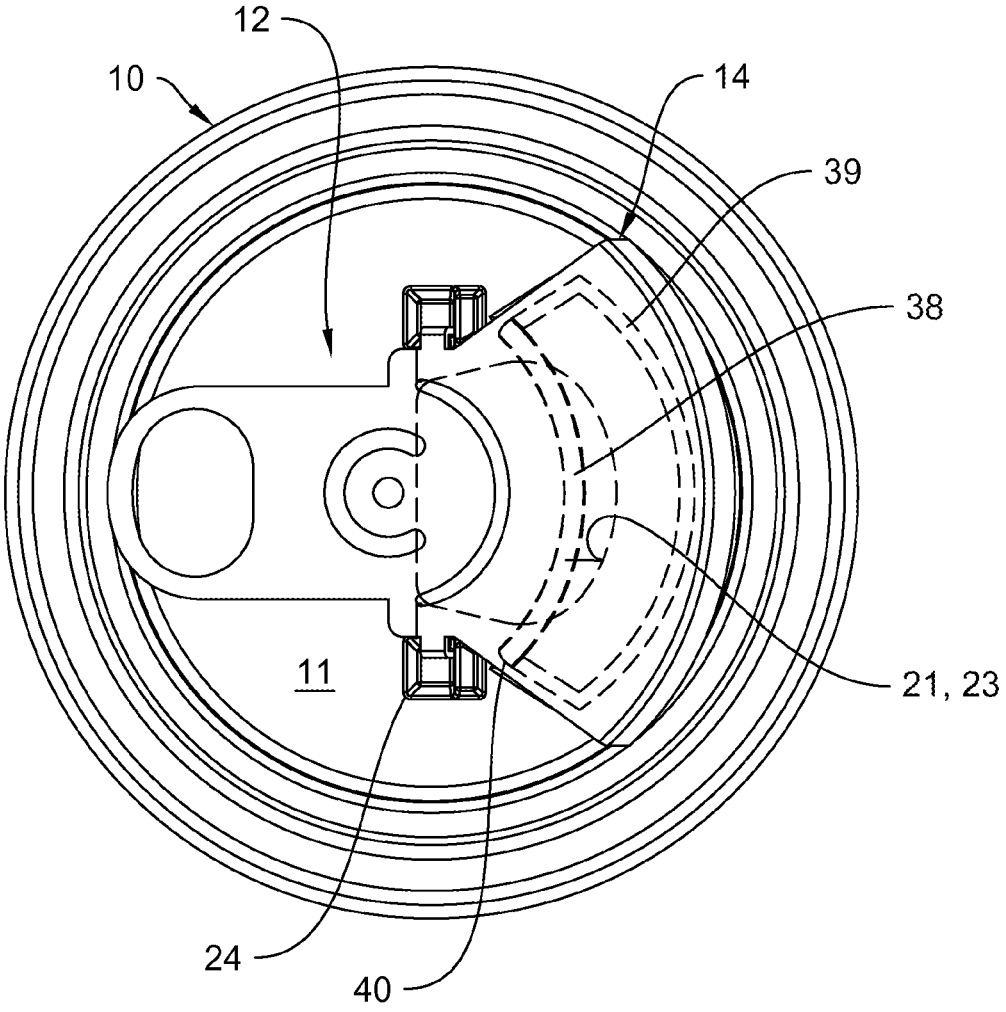
Figure 4:
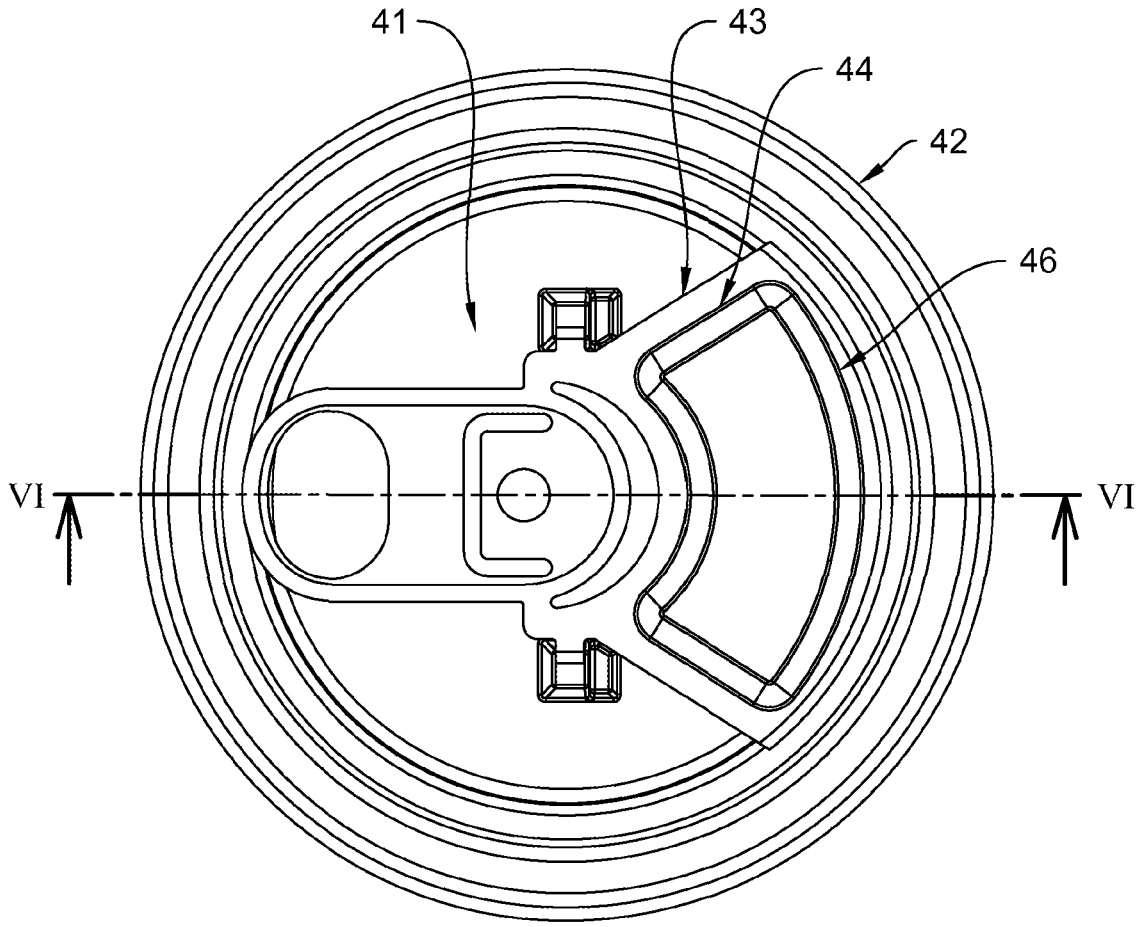
Figure 5:
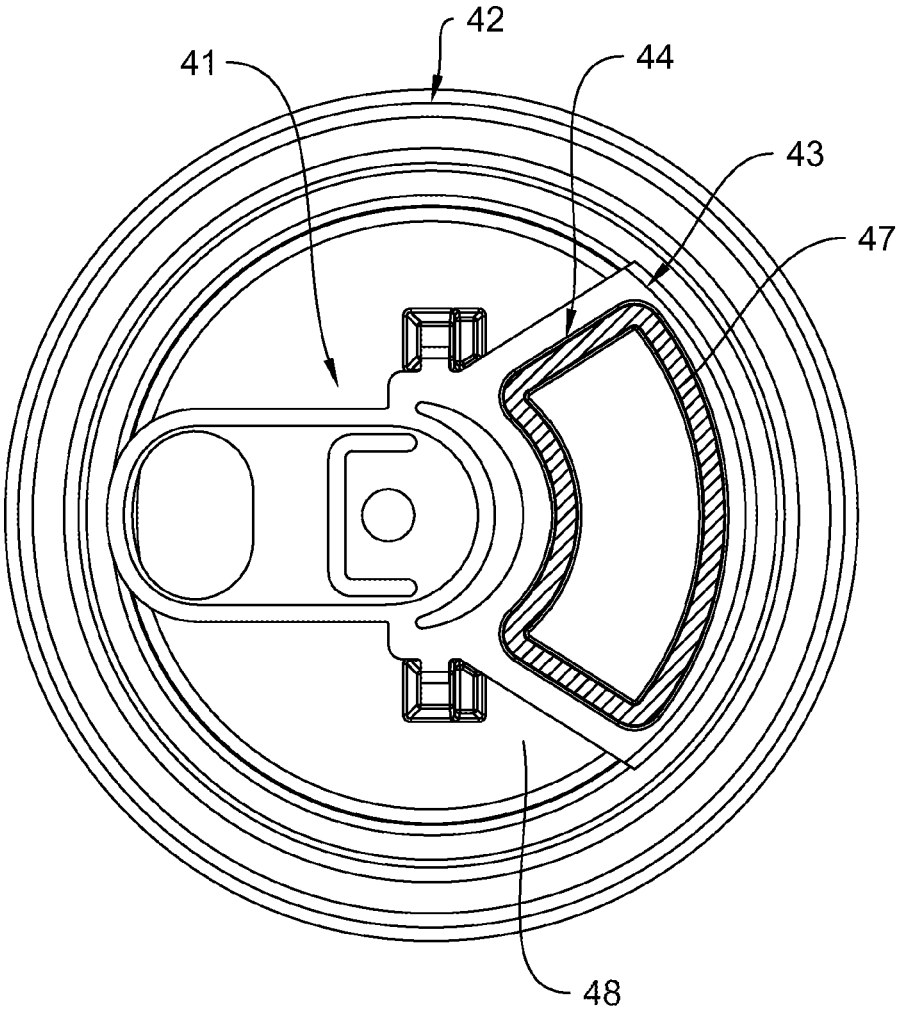
Figure 6:
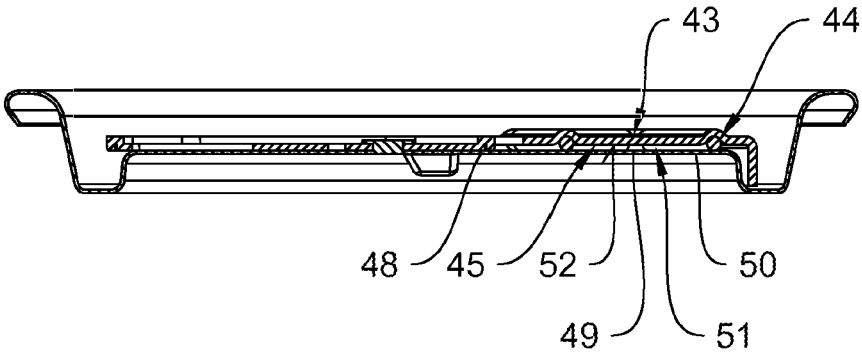
Figure 7:
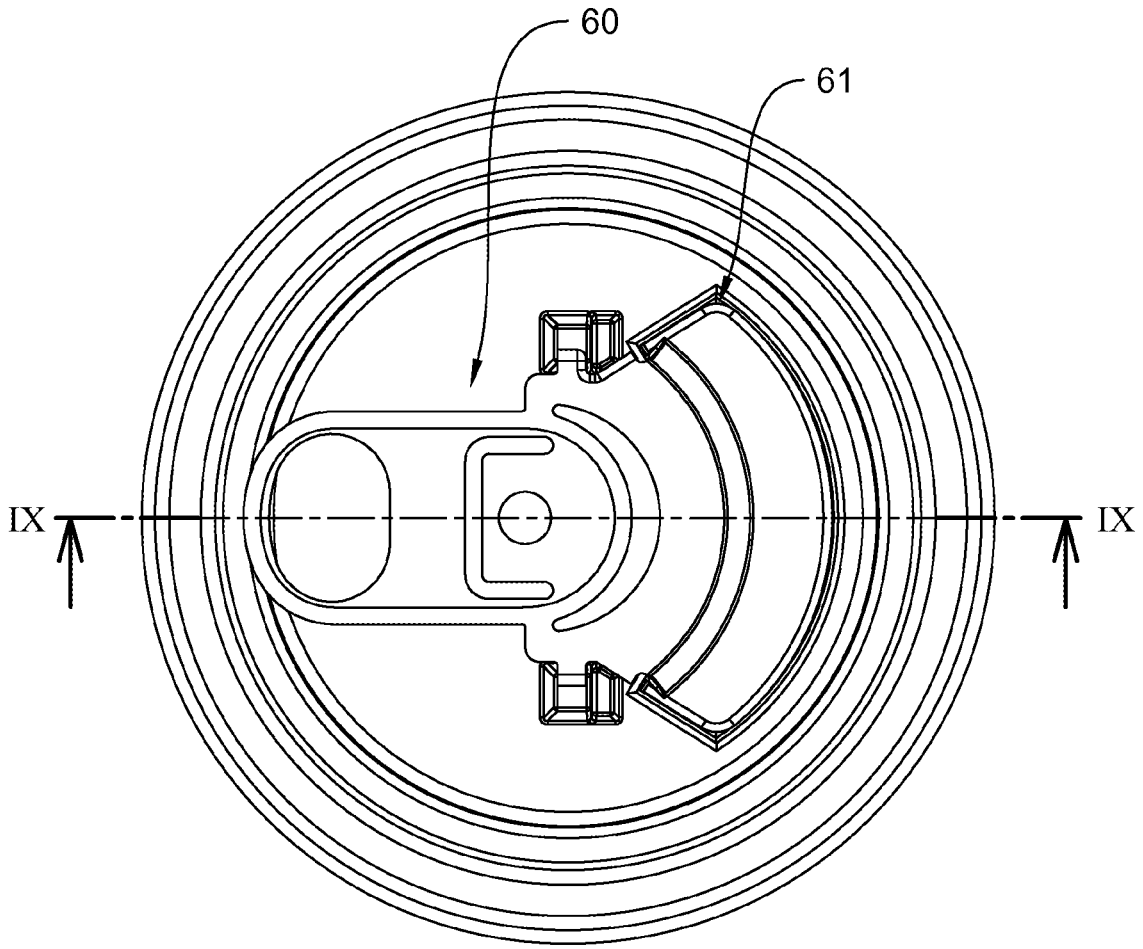

FIG. 2*a* shows a sectional view according to line II-II in FIG. 1 of the can lid illustrated in FIG. 1 having an open container closing device;

FIG. 3 shows a top view of the can lid illustrated in FIG. 1;

FIG. 4 shows a can lid having a container closing device in another embodiment having a sealing device realized in a pouring protrusion of the container closing device;

FIG. 5 shows the can lid illustrated in FIG. 4 including a sectional view of the sealing device;

FIG. 6 shows the can lid illustrated in FIG. 4 in a longitudinal cut according to line VI-VI in FIG. 4;

FIG. 7 shows a top view of a can lid having a container closing device in another embodiment having a sealing device realized partially in the can lid as well as in the pouring protrusion.

Figure 8:
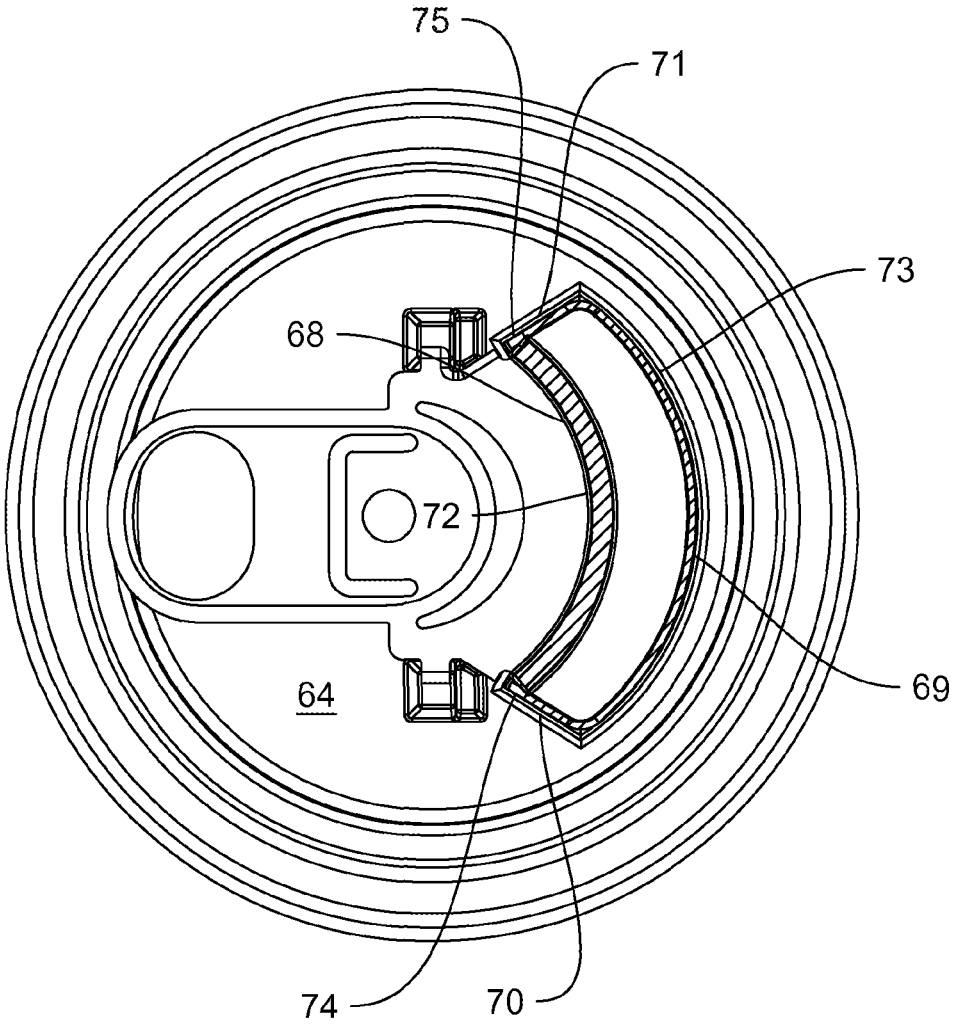
Figure 9:
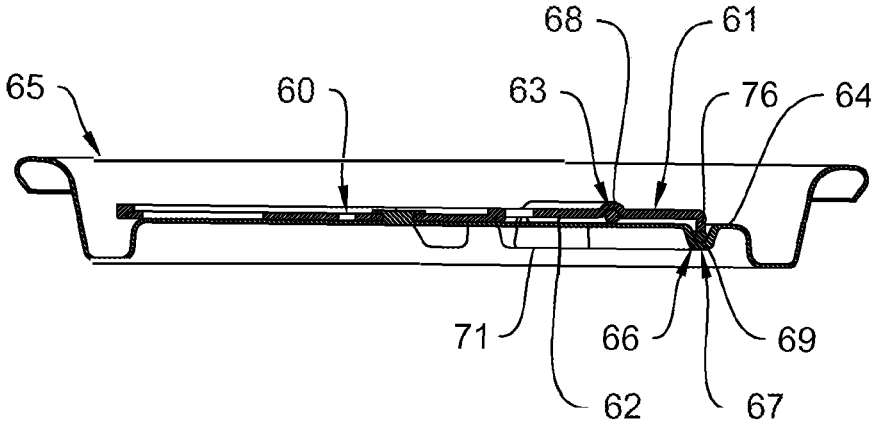

FIG. 8 shows the can lid illustrated in FIG. 7 with the sealing device in a sectional view;

FIG. 9 shows a longitudinal view according to line IX-IX in FIG. 7 of the can lid illustrated in FIG. 7.

FIG. 1 shows an isometric view of a can lid 10 having a container closing device 12 disposed on a lid bottom 11 in an open position, container closing device 12 being illustrated in a closed position in FIG. 2.

Container closing device 12 comprises an opening tab 13 and a pouring protrusion 14. Opening tab 13 comprises a pivot axis 15 which is borne in a pivot reception 16 realized in lid bottom 11. An actuating end 17 is located on one side of pivot axis 15 and can be pivoted about pivot axis 15 by a pivoting movement 18 so that a push opener 19 of opening tab 13 which is realized on the other side of pivot axis 15 opposite actuating end 17 is pivoted against a closing piece 20 realized in the lid bottom, and closing piece 20 is detached from its connection to surrounding lid bottom 11 and pivoted down (FIG. 2*a*) by means of push opener 19 by rupture inducing scores 21 (FIG. 3) being destroyed when continuing opening movement 18 so that a pouring opening 22 is realized in lid bottom 11 having a pouring rim 23 realized in lid bottom 11.

After performing an opening movement 18 until actuating end 17 is pivoted open (not illustrated) to an essentially vertical position with respect to lid bottom 11, a position of closing piece 20 illustrated in FIG. 2*a* results from the effect of pressure from push opener 19 acting on closing piece 20 which is pivoted downward in said position to a corresponding pivot position with respect to lid bottom 11 and is merely connected to lid bottom 11 via a connecting rim area 24.

During opening movement 18, pouring protrusion 14 of container closing device 12 realized on the same side of pivot axis 15 as push opener 19 is supported on lid bottom 11 with a rim web 25 realized on the outer circumference of pouring protrusion 14 so that as a result of opening movement 18 between actuating end 17 of opening tab 13 and pouring protrusion 14, an opening angle $\alpha$ illustrated in FIGS. 1 and 2*a* is realized which leads to an opening mouthpiece 26 having a pouring angle $\beta$ being realized between lid bottom 11 provided with pouring opening 22 and pouring protrusion 14 when pivoting back actuating end 17 contrary to opening movement 18 in a parallel direction of actuating end 17 to lid bottom 11 so that the outpouring liquid flows against a reactive surface 30 disposed on an underside 27 of pouring protrusion 14 when a liquid pours from a beverage can provided with can lid 10.

As FIG. 2 illustrates, reactive surface 30 is located within a sealed space 28 when container closing device 12 is closed, sealed space 28 being limited by a sealing device 29 disposed between underside 27 of pouring protrusion 14 and lid bottom 11. Reactive surface 30 changes the properties of the outpouring liquid when the liquid comes into contact therewith.

Preferably, the reactive surface 30 is designed such that it has a porous surface which is produced in particular by an aluminum oxide coating of underside 27 of pouring protrusion 14 and has a pore size of 40 nm, for example. When producing the container closing device and/or pouring protrusion 14 of container closing device 12 from an aluminum sheet, reactive surface 30 can be produced via an anodizing process, a locally defined formation of reactive surface 30 on underside 27 being able to be enabled by surface areas of underside 27 of pouring protrusion 14 and/or of container closing device 12 not to be provided with an aluminum oxide coating but instead being provided with a suitable passivation, for example a lacquer coating.

If the liquid received in a beverage can provided with the exemplarily illustrated can lid 10 contains oversaturated nitrogen or a gas mixture having dissolved nitrogen, reactive surface 30 can serve to produce bubble nucleation and/or growth in the liquid coming into contact with reactive surface 30 while being poured in order to enable and/or encourage a desired foam growth.

As a synopsis of FIGS. 1 and 2*a* makes clear, sealing device 29 comprises a lid-bottom seal 31 and a pouring-protrusion seal 32 in the case of the exemplary embodiment of container closing device 12 shown in FIGS. 1 to 3, a radially outer bead section 33, which extends parallel to rim web 25 of pouring protrusion 14 and in the circumferential direction of lid bottom 11, and two bead sections 34, 35, which are directed inward and extend transversally to the circumferential direction from the ends of radially outer bead section 33, being provided for realizing lid-bottom seal 31 in lid bottom 11.

For realizing pouring-protrusion seal 32, a radially inner bead section 36 is realized in underside 27 of pouring protrusion 14 and extends between free end areas 37 of bead sections 34, 35, which are directed inward and are formed in lid bottom 11, in such a manner that a sealing means, which is disposed in the radially inner bead section of pouring protrusion 14 and realized as a silicone strand, for example, is disposed with axial sealing ends 40 so as to cover axial sealing ends of a sealing means 39 disposed in bead sections 34, 35 of lid-bottom seal 31, which are directed inward, and preferably realized congruently with sealing means 38.

In FIGS. 4 to 6, another embodiment of a container closing device 41 which is realized on a can lid 42 is shown. Container closing device 41 differs from container closing device 12 in that it has a differently realized pouring protrusion 43, which, as can be seen in particular in FIGS. 4 and 5, is provided with a sealing device 44 which is realized only on an underside 45 of pouring protrusion 43 such that pouring protrusion 43 comprises a sealing device 44 which is realized as a sealing frame and comprises a circumferential bead 46 which is located in underside 45 and is provided with a continuously realized sealing means 47 in the present case which can be realized as a silicone strand comparable to sealing means 38, 39 of the embodiment of container closing device 12 explained in FIGS. 1 to 3.

As in particular FIG. 6 shows, a sealed space 51, in which a reactive surface 52 realized on underside 45 of pouring protrusion 43 is disposed in a sealing manner with respect to an outer environment, is realized between underside 45 of pouring protrusion 43 and a closed lid bottom 48, which has a closing piece 49 connected to the lid bottom via a still intact rupture inducing score 50, by means of sealing device 44. Thus a contact of a liquid received in a beverage can (not illustrated in more detail) below lid bottom 48 with reactive surface 52 only becomes possible if a pouring opening corresponding to pouring opening 22 is formed in lid bottom 48 after performing an opening process of container closing device 41 as referred to in FIGS. 1 to 3.

Moreover, until container closing device 41 has been opened, contact between reactive surface 52 and a medium surrounding lid bottom 48 is only possible after container closing device 41 has been opened.

In FIGS. 7 to 9, another embodiment of a container closing device 60 is shown which has a pouring protrusion 61 changed with respect to pouring protrusion 43 of container closing device 41 while other aspects of the embodiment coincide with container closing device 41. In contrast to pouring protrusion 43, which has sealing device 44 in its entirety on underside 45, pouring protrusion 61 is provided with a pouring-protrusion seal 63 on its underside 62, pouring-protrusion seal 63 forming a sealing device 67 only in conjunction with a lid-bottom seal 66 realized in a lid bottom 64 of can lid 65.

Comparable to sealing device 29 on lid bottom 10 illustrated in FIGS. 1 to 3, pouring-protrusion seal 63 and lid-bottom seal 66, or rather sealing means 72 and/or 73 disposed in a bead section 68 of pouring-protrusion seal 63 and in bead sections 69, 70, 71 of lid-bottom seal 66, are disposed relative to each other in such a manner that axial sealing ends 74 of sealing means 72 are located in a covering position with axial sealing ends 75 of sealing means 73.

In contrast to pouring protrusion 14 of container closing device 12 having rim web 25, which is supported on lid bottom 11, at a distance a from radially outer bead section 33 of sealing device 29 so that rim web 25 is supported directly on lid bottom 11, pouring protrusion 61 comprises a rim web 76, as in particular FIG. 9 shows, which is supported indirectly on lid bottom 64 via sealing means 73 disposed in bead section 69.

The invention claimed is:

1. A container closing device for a beverage can having an opening tab which is disposed on a can lid, is pivotable about a pivot reception formed in a lid bottom and comprises a push opener on one side of a pivot axis received in the pivot reception and an actuating end on an opposite side of the pivot axis for handling, the lid bottom comprising a closing piece, which is divided from the surrounding lid bottom via a rupture inducing score, below the push opener in such a manner that the closing piece is pressurized via the push opener as a result of a pivoting movement of the opening tab and is detached from the connection to the surrounding lid bottom along the rupture inducing score for releasing a pouring opening, the container closing device having a pouring protrusion which is disposed on the same side of the pivot axis as the push opener, covers the closing piece and comprises a support end for supporting the pouring protrusion at the lid bottom during the pivoting movement of the opening tab, the opening tab being provided with a reactive surface on its underside facing the lid bottom for contact with a liquid pouring from the pouring opening, a sealed space being realized in the area of the reactive surface and the closing piece between the pouring protrusion and the lid bottom so that the reactive surface is disposed at least partially in the sealed space and is sealed against an environment.

2. The container closing device according to claim 1, wherein an elastic sealing device is provided for sealing the sealed space between the pouring protrusion and the lid bottom.

3. The container closing device according to claim 1, wherein the rupture inducing score realized in the lid bottom is disposed entirely in the sealed space.

4. The container closing device according to claim 1, wherein the reactive surface realized on the underside of the pouring protrusion is disposed entirely in the sealed space.

5. The container closing device according to claim 1, wherein the sealing device comprises sealing receptions which are disposed in the lid bottom and/or on the underside of the pouring protrusion and serve to receive a seal.

6. The container closing device according to claim 5, wherein the sealing receptions are at least partially realized as receiving beads realized in the underside of the pouring protrusion and/or in the lid bottom.

7. The container closing device according to claim 1, wherein the support end of the pouring protrusion is realized as a rim web which is supported at the lid bottom having the seal sandwiched therebetween.

8. The container closing device according to claim 7, wherein the sealing device has a lid-bottom seal and a pouring-protrusion seal, a radially outer bead section, which extends parallel to the rim web of the pouring protrusion and extends in the circumferential direction of the lid bottom, and two bead sections, which are directed inward and each extend transversally to the circumference from the ends of the radially outer bead section, being provided for realizing the lid-bottom seal in the lid bottom, a radially inner bead section being realized in the underside of the pouring protrusion for realizing the pouring-protrusion seal, the radially inner bead section extending between free end areas of the bead sections, which are directed inward and realized in the lid bottom, in such a manner that a seal, which is disposed in the radially inner bead section of the pouring protrusion, covers axial sealing ends of the seal disposed in the bead sections of the lid-bottom seal, which are directed inward, with axial sealing ends.

9. The container closing device according to claim 7, wherein the sealing device is realized as a sealing frame disposed at the lid bottom and having a circumferential bead in the lid bottom.

10. The container closing device according to claim 1, wherein the support end of the pouring protrusion is realized as a rim web which is supported at the lid bottom adjacent to the seal disposed on the underside of the pouring protrusion.

11. The container closing device according to claim 10, wherein the sealing device is realized as a sealing frame disposed in the pouring protrusion and having a circumferential bead in the underside of the pouring protrusion.

12. The container closing device according to claim 1, wherein the reactive surface is provided with a surface for encouraging bubble nucleation and bubble growth in a liquid which is received in the beverage can and contains oversaturated nitrogen or a gas mixture comprising dissolved nitrogen.

13. The container closing device according to claim 1, wherein the reactive surface is provided with an anodically produced aluminum oxide coating of a partial area of the underside of the pouring protrusion.

14. A beverage can having a container closing device according to claim 1.

* * * * *